US006994341B2

(12) United States Patent
Aoki et al.

(10) Patent No.: US 6,994,341 B2
(45) Date of Patent: Feb. 7, 2006

(54) SHEET FEEDING DEVICE AND IMAGE FORMING APPARATUS EQUIPPED WITH THE SAME

(75) Inventors: Daisuke Aoki, Shizuoka (JP); Yoshihiro Ito, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/606,312

(22) Filed: Jun. 26, 2003

(65) Prior Publication Data

US 2005/0087921 A1 Apr. 28, 2005

(30) Foreign Application Priority Data

Jul. 12, 2002 (JP) ..... 2002-204598

(51) Int. Cl.
*B65H 3/06* (2006.01)

(52) U.S. Cl. ..... 271/117; 271/126; 271/152; 271/153; 271/155

(58) Field of Classification Search ..... 271/110, 271/114, 117, 118, 122, 126, 152, 153, 155
See application file for complete search history.

(56) References Cited

U.S. PATENT DOCUMENTS

| | | | | |
|---|---|---|---|---|
| 3,945,726 A | | 3/1976 | Ito et al. | 355/3 R |
| 4,000,942 A | | 1/1977 | Ito et al. | 355/3 R |
| 4,050,691 A | | 9/1977 | Ito et al. | 271/124 |
| 4,346,878 A | * | 8/1982 | Aizawa | 271/118 |
| 4,953,037 A | | 8/1990 | Ito et al. | 358/496 |
| 5,562,280 A | | 10/1996 | Niimura et al. | 271/248 |
| 5,842,694 A | * | 12/1998 | Brooks et al. | 271/38 |
| 5,988,628 A | | 11/1999 | Mori | 271/117 |
| 6,056,285 A | * | 5/2000 | Kikuta et al. | 271/118 |
| 6,070,867 A | * | 6/2000 | Tsurumi et al. | 271/114 |
| 6,442,356 B2 | | 8/2002 | Omata et al. | 399/66 |
| 6,443,445 B1 | * | 9/2002 | Bortolotti | 271/117 |

(Continued)

FOREIGN PATENT DOCUMENTS

EP 0 888 988 A2 1/1999

(Continued)

OTHER PUBLICATIONS

Official Letter/Search Report issued on Jun. 3, 2005, by the Chinese Patent Office, in Chinese Patent Application No. 031482724.

*Primary Examiner*—David H. Bollinger
(74) *Attorney, Agent, or Firm*—Fitzpatrick, Cella, Harper & Scinto

(57) ABSTRACT

A sheet feeding device in which sheets contained in a sheet container detachably attached to an apparatus main body are fed by a sheet feeder, including a sheet support member provided in the sheet container to vertically move while supporting the sheets, a lifter for raising and lowering the sheet support member, a cam member to lower the sheet feeder to bring it into contact with the sheets when the sheets are sent out and to raise the sheet feeder to an upper initial position on standby, a detector for detecting the height of the sheets according to the position at which the sheet feeder abuts against the sheets, and a controller for controlling the raising and lowering operations of the lifter on the basis of the detection result of the height of the sheets as obtained by the detector to maintain the uppermost surface of the sheets at a predetermined height, in which, when the sheet container is accommodated in the apparatus main body, the raising operation of the cam member is canceled by the sheet container, and the sheet feeder is lowered from the initial position to enable the detector to perform detection.

15 Claims, 8 Drawing Sheets

U.S. PATENT DOCUMENTS

| | | | | |
|---|---|---|---|---|
| 6,783,126 | B2 * | 8/2004 | Amamoto | 271/152 |
| 2003/0090053 | A1 * | 5/2003 | Hsiao et al. | 271/118 |

FOREIGN PATENT DOCUMENTS

| | | |
|---|---|---|
| JP | 6-171771 | 6/1994 |
| JP | 7-53065 | 2/1995 |
| JP | 8-127437 | 5/1996 |
| JP | 9-226949 | 9/1997 |
| JP | 2000-95359 | 4/2000 |
| JP | 2002-145460 | 5/2002 |

* cited by examiner

SHEET FEEDING DEVICE AND IMAGE FORMING APPARATUS EQUIPPED WITH THE SAME

BACKGROUND OF THE INVENTION

1. Field of the Invention

The present invention relates to a sheet feeding device and an image forming apparatus equipped with the same, and in particular, to a construction for controlling an upper surface position of sheets contained in a sheet containing means.

2. Related Background Art

In recent years, image forming apparatuses, such as printers, copying machines, and facsimile apparatuses, are equipped with a sheet feeding device for feeding sheets one by one to an image reading portion or an image forming portion. As an example of this sheet feeding device, one adopting a retard separation system capable of separating sheets with high reliability over a range from low speed to high speed is in general use.

The retard separation system is a system in which sheets sent out from a pick-up roller serving as the sheet feeding means are fed one by one with a feed roller rotating in a sheet feeding direction and a retard roller in contact with the feed roller under a predetermined pressure and rotating in a direction opposite to the sheet feeding direction, i.e., so as to return sheets.

Apart from this, a conventional sheet feeding device adopts an ascent/descent system in which the pick-up roller is capable of ascending and descending, and in which, when sheet feeding is to be performed, the pick-up roller is lowered to be brought into contact with the sheets to be sent out, whereas when the operation of sending out sheets is not to be performed, the pick-up roller is raised so as to be spaced apart from the sheets. By thus spacing the pick-up roller apart from the sheets, the pick-up roller constitutes no load during transport and separation of the sheets; further, the sheets returned by the retard roller can be reliably returned to the cassette, thereby achieving an improvement in separability.

FIG. 8 shows a construction of a conventional sheet feeding device adopting this pick-up roller ascent/descent system; in this device, sheets supported by an inner plate 41A incorporated in a sheet feeding cassette 4A are sent out by a pick-up roller 56. This pick-up roller 56 is rotatably supported by a rotation end portion of a roller holder 58 rotatably mounted to a shaft 57*a* of a feed roller 57, and is capable of ascending and descending.

The roller holder 58 is equipped with a sensor flag 59, which is detected by an optical sensor 60. A position where the optical sensor 60 detects the sensor flag 59 is the position where a proper sheet feeding pressure is applied to an upper surface of the sheets P by the pick-up roller 56 at the time of feeding.

The inner plate 41A is capable of ascending and descending while supporting the sheets; when the sheets P have been reduced as a result of feeding and the optical sensor 60 can not detect the sensor flag 59, the inner plate 41 ascends; and when the optical sensor 60 detects the sensor flag 59, the ascent of the inner plate 41A is stopped based on this detection. As a result, the sheets P contained in the sheet feeding cassette 4A are sent out; each time the height of the uppermost surface of the sheets becomes lower than a given height, the inner plate 41A is raised, making it possible to maintain the uppermost surface of the sheets P substantially at a predetermined level at which the proper sheet feeding pressure is applied to the sheets P.

Incidentally, in such a conventional sheet feeding device, after sending out sheets P, the pick-up roller 56 ascends to be spaced apart from the sheets P1 as described above; this also applies to the case in which the last sheet in the sheet feeding cassette 4A has been sent out, so that, when the last sheet has been sent out, the pick-up roller moves to its initial position above the sheet feeding cassette.

Then, also, when sheets are supplied and the sheet supplying cassette 4A is attached to the apparatus main body, the pick-up roller 56 is situated at the initial position. When the pick-up roller 56 is thus situated at the initial position, the sensor flag 59 shields the optical sensor 60.

However, when the optical sensor 60 has already been thus shielded when the sheet feeding cassette 4A is attached, the control portion determines that sheet feeding is possible even if the uppermost surface of the sheets P has not yet reached the substantially predetermined level at which the proper sheet feeding pressure is applied to the sheets P. That is, when the optical sensor 60 is shielded, it is impossible to accurately judge the position of the sheets P.

Then, when it is thus impossible to accurately judge the position of the sheets P, sheet feeding operation is started although the sheets P have not reached the position where sheet feeding is possible. As a result, there is a fear of defective sheet feeding, or, in some cases, an excessive rise of the inner plate due to control thereof, which causes a problem such as deformation of components.

SUMMARY OF THE INVENTION

The present invention has been made in view of the above-mentioned circumstances. It is an object of the present invention to provide a sheet feeding device, which has a simple construction and is capable of reliably moving sheets to a position where sheet feeding is possible, and an image forming apparatus equipped with such a sheet feeding device.

According to the present invention, there is provided a sheet feeding device in which sheets contained in a sheet containing means detachably attached to an apparatus main body are fed by a sheet feeding means including: a sheet support member provided in the sheet containing means and capable of vertical moving while supporting the sheets; a lifter means capable of raising and lowering the sheet support member; a cam member adapted to lower the sheet feeding means so as to bring it into contact with the sheets when the sheets supported by the sheet support member are to be sent out and to raise the sheet feeding means to the upper initial position on standby; a detection means for detecting the height of the uppermost surface of the sheets according to the position at which the sheet feeding means abuts against the sheets; and a control means for controlling the raising and lowering operations of the lifter means on the basis of the result of the detection of the height of the uppermost surface of the sheets as obtained by the detection means to maintain the uppermost surface of the sheets supported by the sheet support member at a predetermined height, in which, when the sheet containing means is accommodated in the apparatus main body, the raising operation of the cam member is canceled by the sheet containing means, and the sheet feeding means is lowered from the initial position to make it possible for the detection means to perform detection.

According to the present invention, there is provided a sheet feeding device in which sheets contained in a sheet feeding cassette detachably attached to an apparatus main body are fed by a pick-up roller including: a holder supporting the pick-up roller so as to allow it to swing vertically; an inner plate which is rotatably provided in the sheet feeding cassette and on which sheets are stacked; a push-up plate provided in the apparatus main body and adapted to push up the inner plate by rotating; a cam member having an outer circumferential portion adapted to abut against an abutment portion provided on the holder to raise the pick-up roller to a position above the sheet feeding cassette, and a linear portion adapted to lower the pick-up roller so as to bring it into contact with the uppermost surface of the sheets stacked on the inner plate; a position detection sensor adapted to detect whether the position where the pick-up roller abuts against the sheets is set at a predetermined position or not according to whether a flag provided on the holder is detected or not; a control means for controlling the pushing-up operation of the push-up plate on the basis of the detection by the position detection sensor; and a lever adapted to rotate the cam member to cause the portion of the cam member against which the holder abuts to shift from the outer circumferential portion to the linear portion when the sheet feeding cassette is accommodated in the apparatus main body.

DESCRIPTION OF THE PREFERRED EMBODIMENTS

An embodiment of the present invention will now be described with reference to the drawings.

Figure 1:
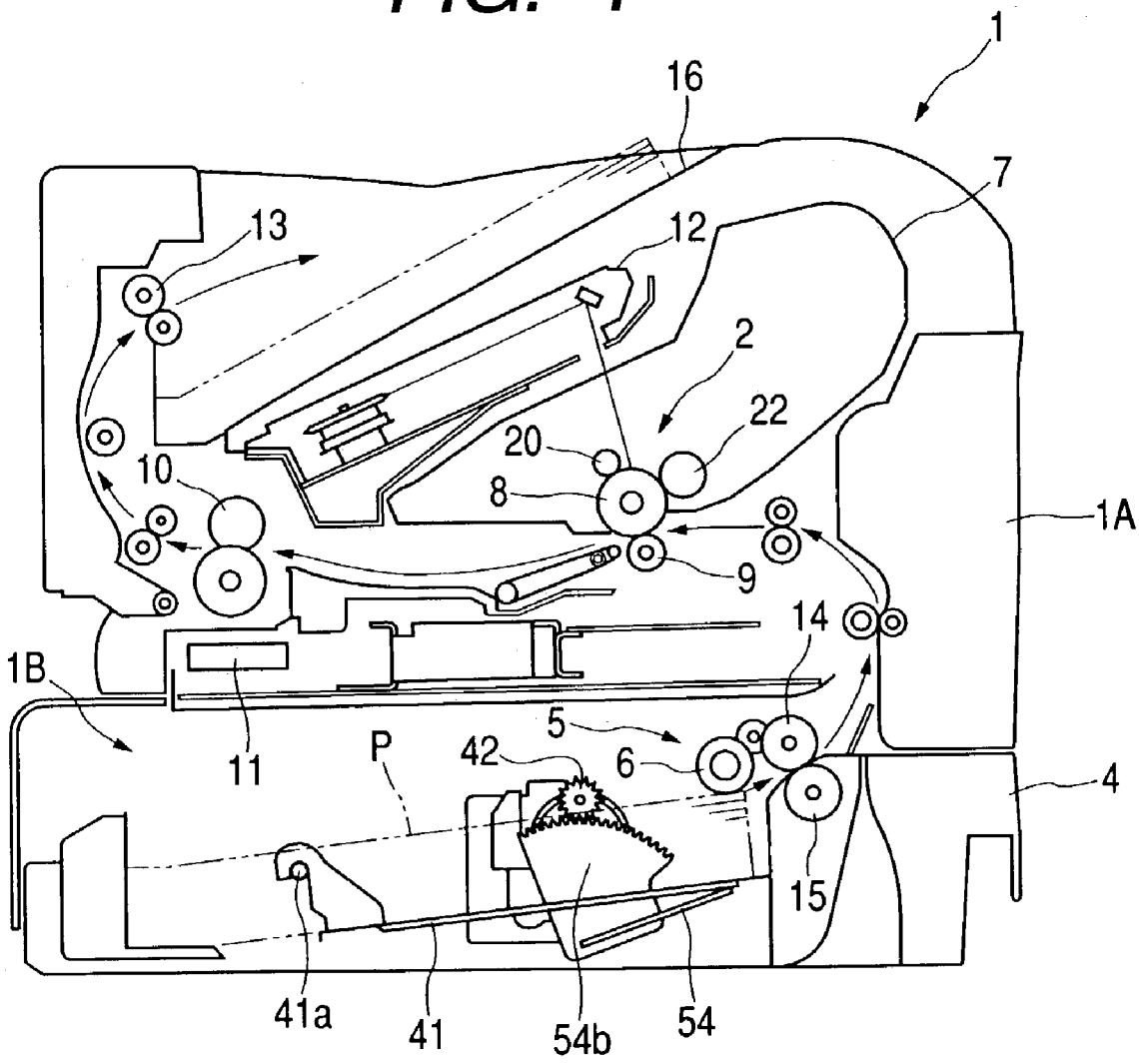
FIG. 1 is a schematic diagram showing a construction of a laser beam printer constituting an example of an image forming apparatus equipped with a sheet feeding device according to an embodiment of the present invention.

FIG. 1 is a schematic diagram showing a construction of a laser beam printer constituting an example of an image forming apparatus equipped with a sheet feeding device according to an embodiment of the present invention.

In FIG. 1, a laser beam printer 1 is equipped with an image forming portion 2 for performing image formation, a sheet feeding device 5 for feeding sheets P one by one to the image forming portion 2, etc.

The image forming portion 2 is equipped with a process cartridge 7 which is attachable to and detachable from a laser beam printer main body (hereinafter referred to as the apparatus main body), a transfer roller 9, a fixing unit 10, etc., and the sheet feeding device 5 is equipped with a sheet separation feeding portion composed of a sheet feeding cassette 4 serving as a sheet containing means for containing sheets stacked together, a pick-up roller 6 serving as a sheet feeding means, a feed roller 14, and a retard roller 15. The process cartridge 7 is equipped with a photosensitive drum 8, a charging roller 20, a developing means 22, a cleaning means (not shown), etc.

The charging roller 20 is held in contact with the photosensitive drum 8 so that it may be driven to rotate with the photosensitive drum 8, and serves to uniformly charge the surface of the photosensitive drum 8 when the same rotate. The developing means 22 supplies toner to a development region of the photosensitive drum 8 to develop a latent image formed thereon.

Further, in FIG. 1, reference numeral 12 indicates a laser scanner unit, reference numeral 13 indicates a delivery roller for delivering sheets P onto a sheet delivery stack table 16, reference numeral 1B indicates a cassette accommodating portion provided in the apparatus main body 1A, and reference numeral 11 indicates a control portion.

Next, an image forming operation of the laser beam printer 1, constructed as described above, will be illustrated.

When image information is transmitted from a personal computer or the like (not shown), and when a controller board (not shown) which has performed image forming processing on the image information issues a print signal, the sheets P stacked on the sheet feeding cassette 4 detachably attached to the apparatus main body 1A are fed one by one by the sheet separation feeding portion, and sent to the nip of the photosensitive drum 8 and the transfer roller 9 in the process cartridge 7.

With this print command, image information in the form of a bit image (laser beam) is applied to the photosensitive drum from the laser scanner unit 12 on the basis of the image information, and a latent image is formed on the surface of the photosensitive drum 8 in accordance with this bit image. Further, by developing this latent image, a toner image is formed on the photosensitive drum.

Then, the toner image thus formed on the photosensitive drum is thereafter transferred to the sheet P conveyed to the nip of the photosensitive drum 8 and the transfer roller 9. Further, the sheet P to which the toner image has been transferred is sent to a fixing unit 10, where it is heated and pressurized, whereby the toner image is fixed semipermanently. Thereafter, the sheet P with the toner image fixed thereto is delivered onto the sheet delivery stack table 16 by the delivery roller 13.

Figure 2:
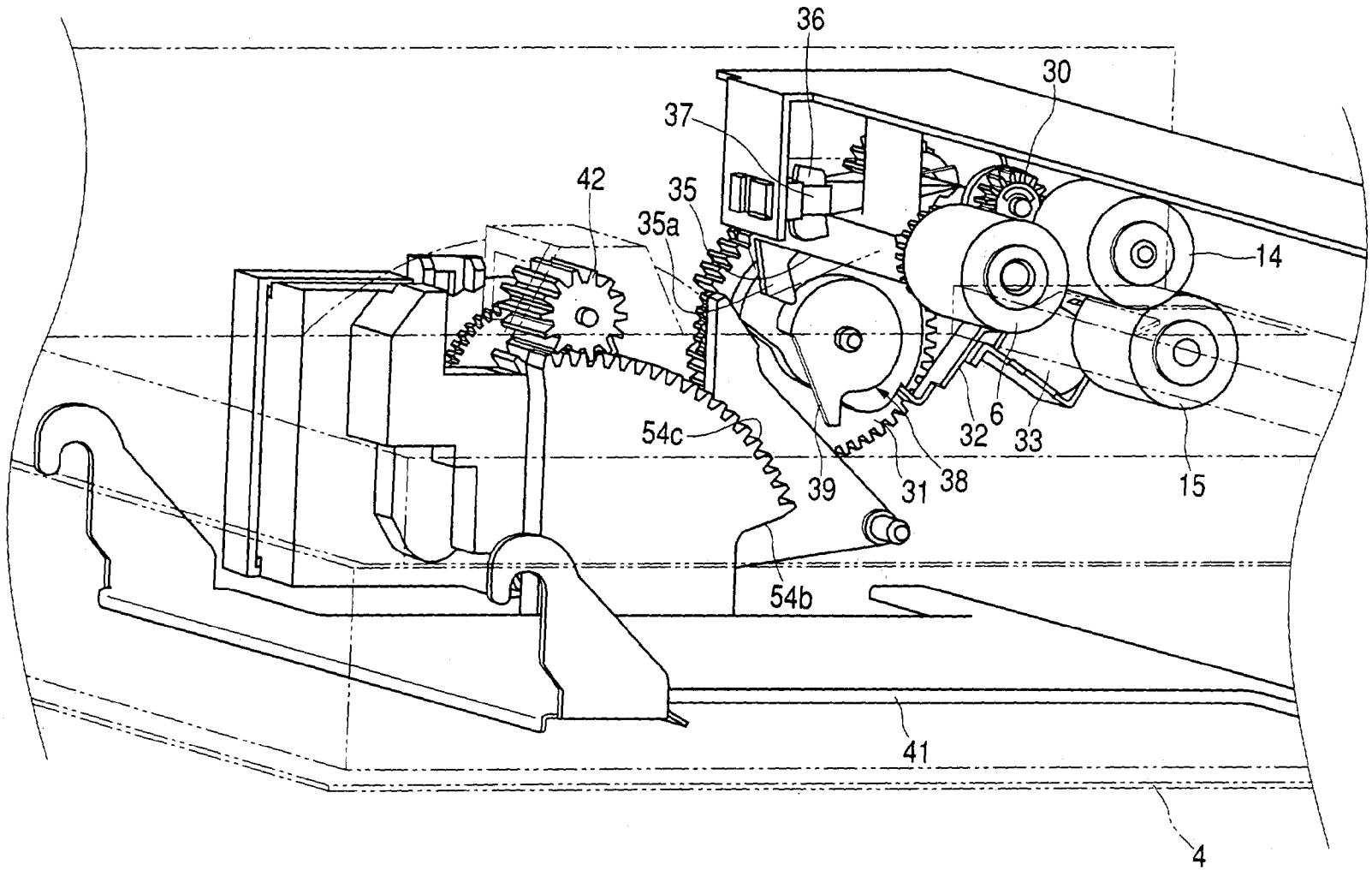
FIG. 2 is a main-portion perspective view for illustrating a construction of the sheet feeding device of the laser beam printer.

FIG. 2 illustrates the construction of the sheet feeding device 5. In FIG. 2, reference numeral 31 indicates a partially-toothless gear for rotating the feed roller 14, and reference numeral 32 indicates a trigger member operated by a solenoid 33. And, through one-revolution control of the partially-toothless gear 31 by the trigger member 32 operated by the solenoid 33, the feed roller 14 makes several rotations. Further, the rotation of the feed roller 14 is transmitted to a pick-up roller 6 through a planetary gear 30.

In FIG. 2, reference numeral 41 indicates an inner plate provided in the sheet feeding cassette 4 and serving as a sheet support member. This inner plate 41 is provided in the sheet feeding cassette 4 so as to be vertically rotatable (movable) using an engagement portion 41*a* shown in FIG. 1 as a fulcrum. Reference numeral 54*b* indicates a fan-shaped gear provided at one end of a push-up plate 54 provided below the inner plate 41; it is equipped with a gear portion 54*c* to mesh with a pinion 42 rotated by a motor (not shown) provided in the apparatus main body. Through the rotation of the pinion 42, the fan-shaped gear 54*b* is rotated and the inner plate 41 is rotated by the push-up plate 54 to raise or lower the sheets. The pinion 42, the fan-shaped gear 54*b*, the push-up plate 54, etc., form a lifter means according to the present invention.

The motor (not shown) is drive-controlled by the control portion 11, which causes the pinion 42 to be rotated by the motor on the basis of a detection signal from a position detection sensor described below, and causes the inner plate 41 to move in the direction of the pick-up roller 6 through the gear portion 54*c* and the push-up plate 54, raising the inner plate 41 to a substantially predetermined height at which the proper pressure is applied between the pick-up roller 6 and the uppermost surface of the sheets P supported by the inner plate 41 at the time of sheet feeding.

Figure 3:
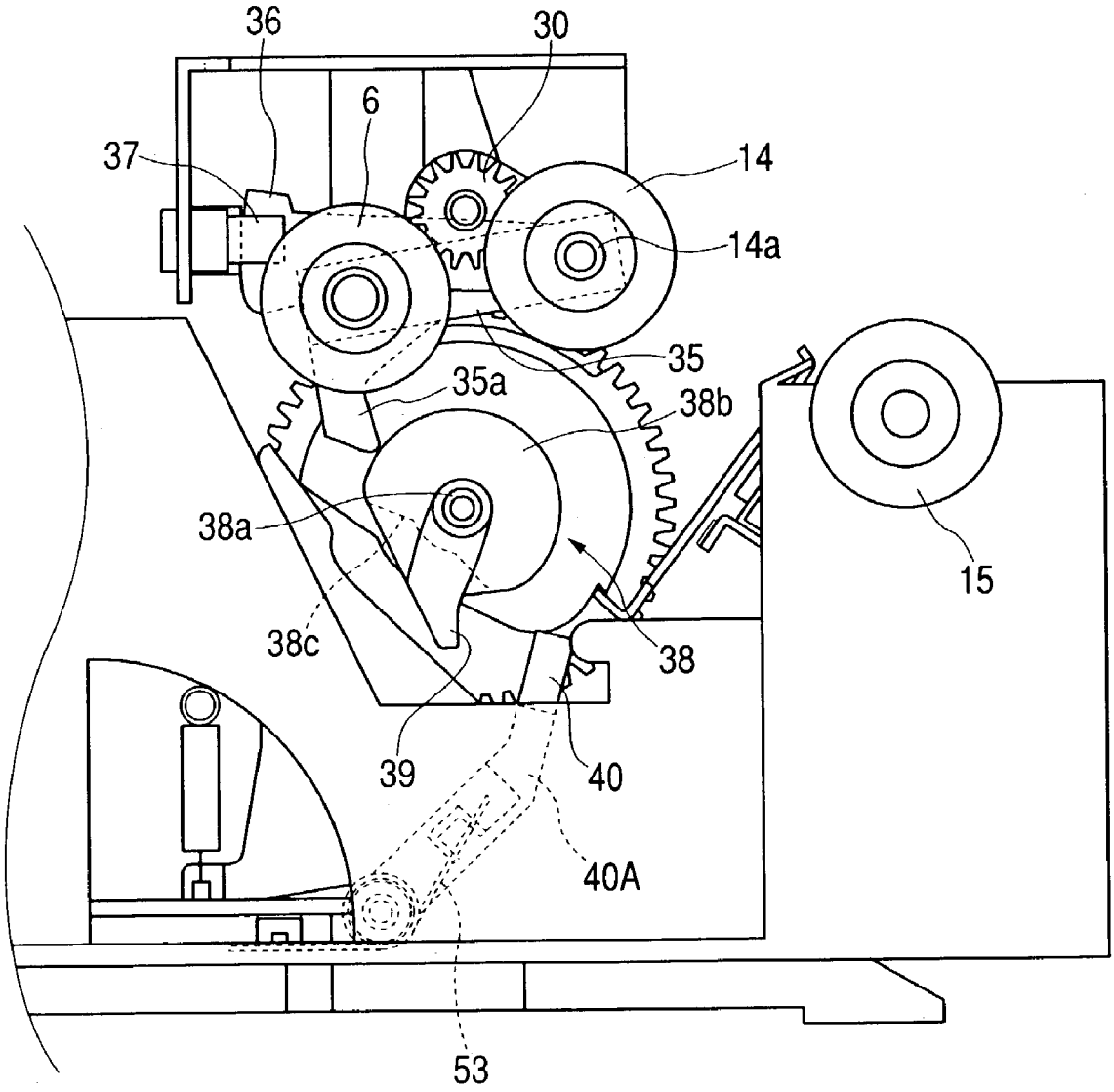
FIG. 3 is a main-portion side view showing a state of the sheet feeding apparatus, in which a sheet feeding cassette has not yet been accommodated in the laser beam printer.

The pick-up roller 6 is rotatably supported by a roller holder 35 rotatably mounted to the shaft 14*a* of the feed roller 14 shown in FIG. 3. This roller holder 35 is equipped with a sensor flag 36. When the pick-up roller 6 is at the initial position as shown in FIG. 3, this sensor holder 35 shields the position detection sensor 37. The roller holder 35, the sensor flag 36, the position detection sensor 37, etc., form a detection means according to the present invention.

Further, in FIG. 3, reference numeral 38 indicates a cam member adapted to be engaged with the partially-toothless gear 31 when the partially-toothless gear 31 rotates, so that the cam member rotates with the partially-toothless gear 31. Provided at the rotation end of the roller holder 35 is an abutment portion 35*a* adapted to abut against the cam member 38. This cam member 38 is mounted so as to be capable of rotating relative to the partially-toothless gear 31 within a predetermined angle range. Thus, the cam member 38 is capable of rotating independently of the partially-toothless gear 31.

Then, when the partially-toothless gear 31 is controlled so as to make one revolution by causing this abutment portion 35*a* to abut against the cam member 38 by its own weight or by an urging member such as a spring (not shown), the pick-up roller 6 falls to moved to a position where it abuts against the sheet due to the configuration of the cam member 38, and retracts from the sheets in the course of sending out the sheets, then it returns to the initial position before long as shown in FIG. 3.

As the sheets P are fed one by one through this control, the number of sheets stacked on the inner plate 41 is reduced and the uppermost surface of the sheets becomes lower, with the result that the pick-up roller 6 descends together with the roller holder 35, then the shielding of the position detection sensor 37 by the sensor flag 36 is canceled before long due to the descent of the roller holder 35 to bring about a non-detection state.

When the roller holder 35 thus descends to the position where the shielding of the position detection sensor 37 is canceled, that is, to the position where the position detection sensor 37 is brought into the non-detection state, it becomes impossible to apply the proper sheet feeding pressure to the uppermost surface of the sheets P by the pick-up roller 6. Thus, when the position detection sensor 37 is brought into the non-detection state, the control portion 11 drive-controls the motor so as to raise the inner plate 41 again by the push-up plate 54 of the lifter means to the substantially predetermined level where the proper pressure is applied to the uppermost surface of the sheets P.

And, when the position detection sensor 37 is brought into the non-detection state while the sheets P are being successively fed, at the position of the roller holder 35 (pick-up roller 6) being detected by the position detection sensor 37, the inner plate 41 is moved by the lifter means to bring the uppermost surface of the sheets P to the predetermined position; by repeating this control, it is possible to reliably feed the sheets P until there is no sheet P left.

In this embodiment, the cam member 38 is equipped with an engagement portion 39 serving as a pressurizing portion for forcibly rotating the cam member 38 being pressurized by a lever 40. As described below, this engagement portion 39 is mounted to the shaft 38*a* of the cam member 38 so as to be rotatable counterclockwise by a predetermined angle in a case that a counterclockwise force is applied from the lever 40 when the lever 40 returns; it is maintained at the position shown in FIG. 3 by a spring (not shown).

Figure 4:
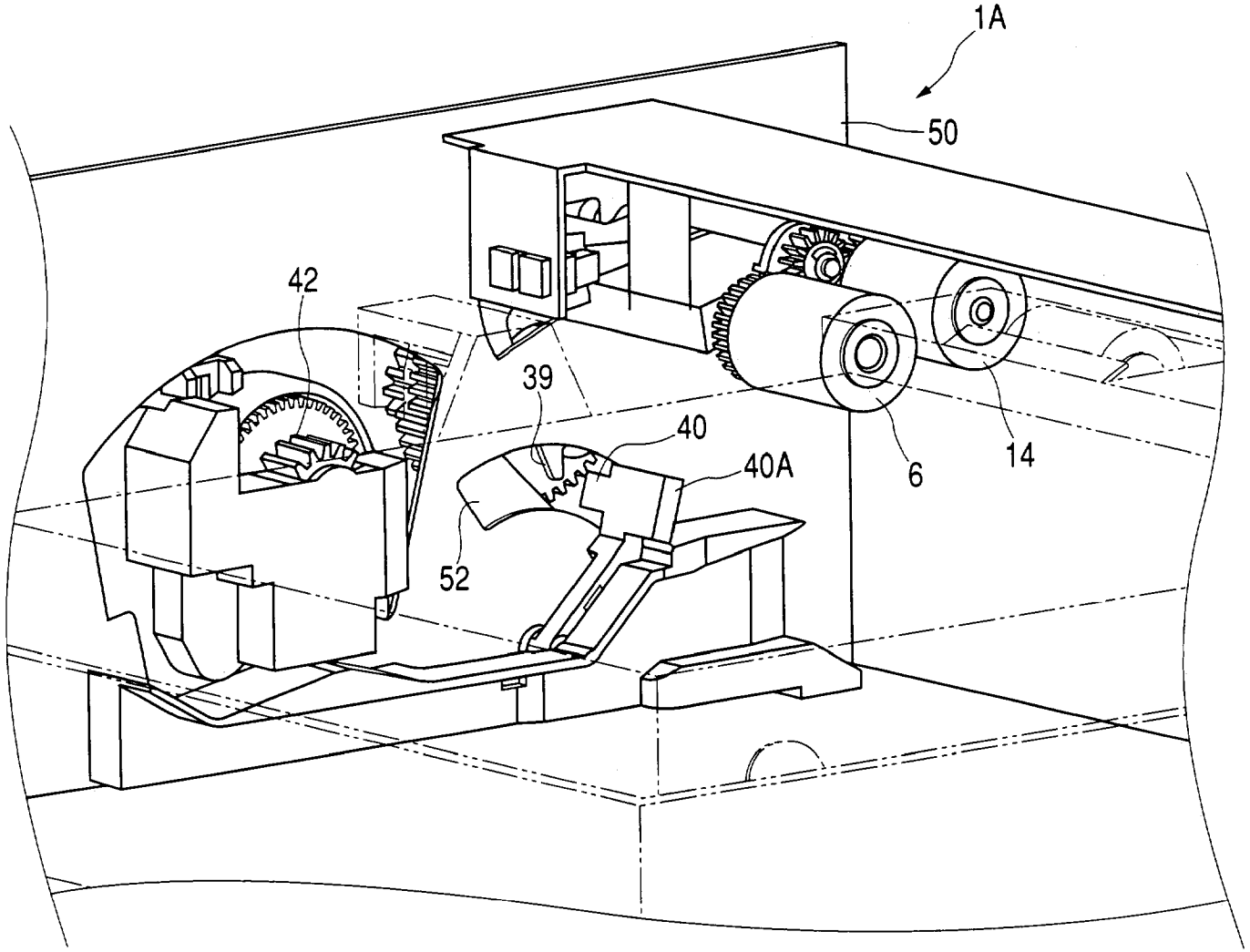
FIG. 4 is a main-portion perspective view showing a state of the laser beam printer, in which the sheet feeding cassette has not yet been accommodated therein.

Further, the lever 40 protrudes from the side surface of a canceling member 40A rotatably provided on the sheet feeding cassette accommodating portion side as shown in FIG. 4, and protrudes toward the engagement portion side from an arcuate opening 52 formed in a frame 50 of the apparatus main body 1A.

Figure 5:
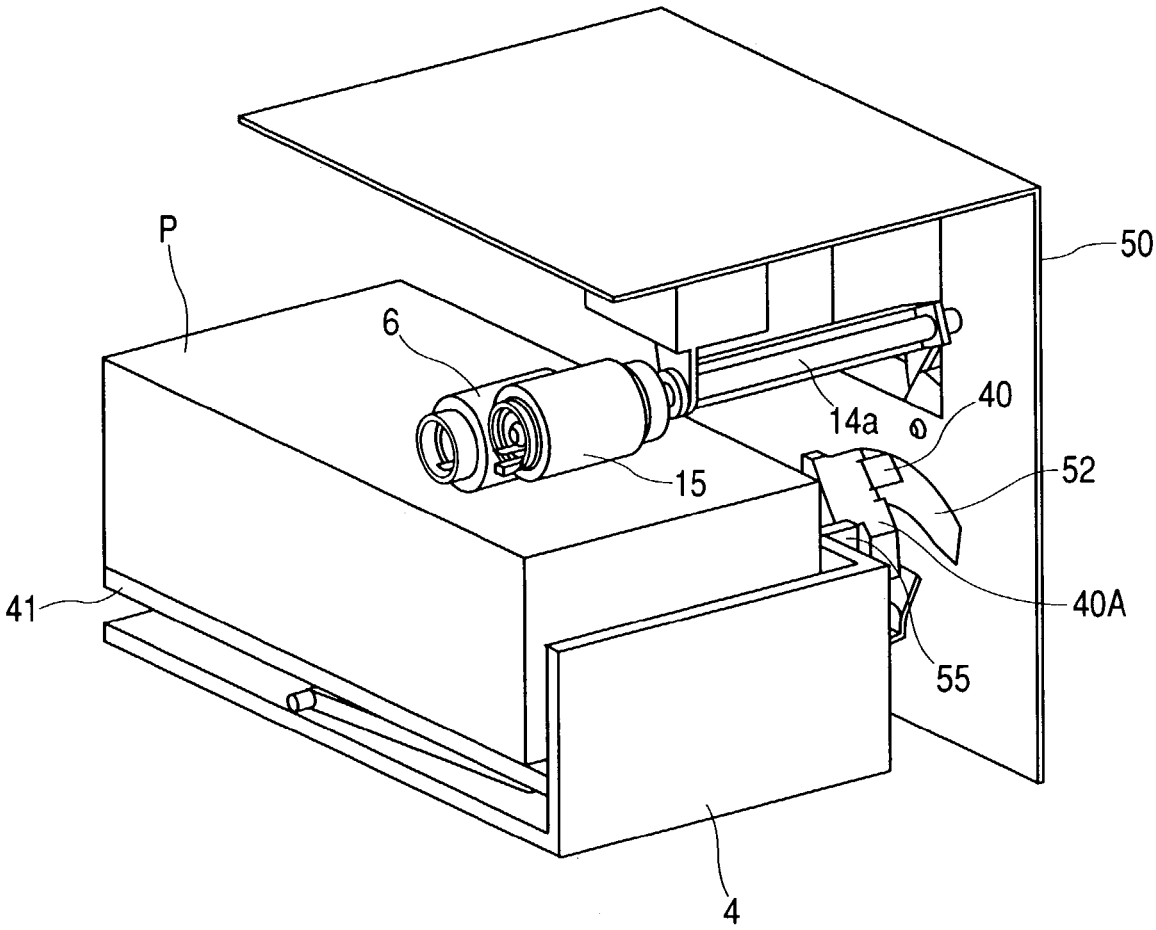
FIG. 5 is a main-portion perspective view showing a state of the laser beam printer, in which the sheet feeding cassette has been accommodated therein.
Figure 6:
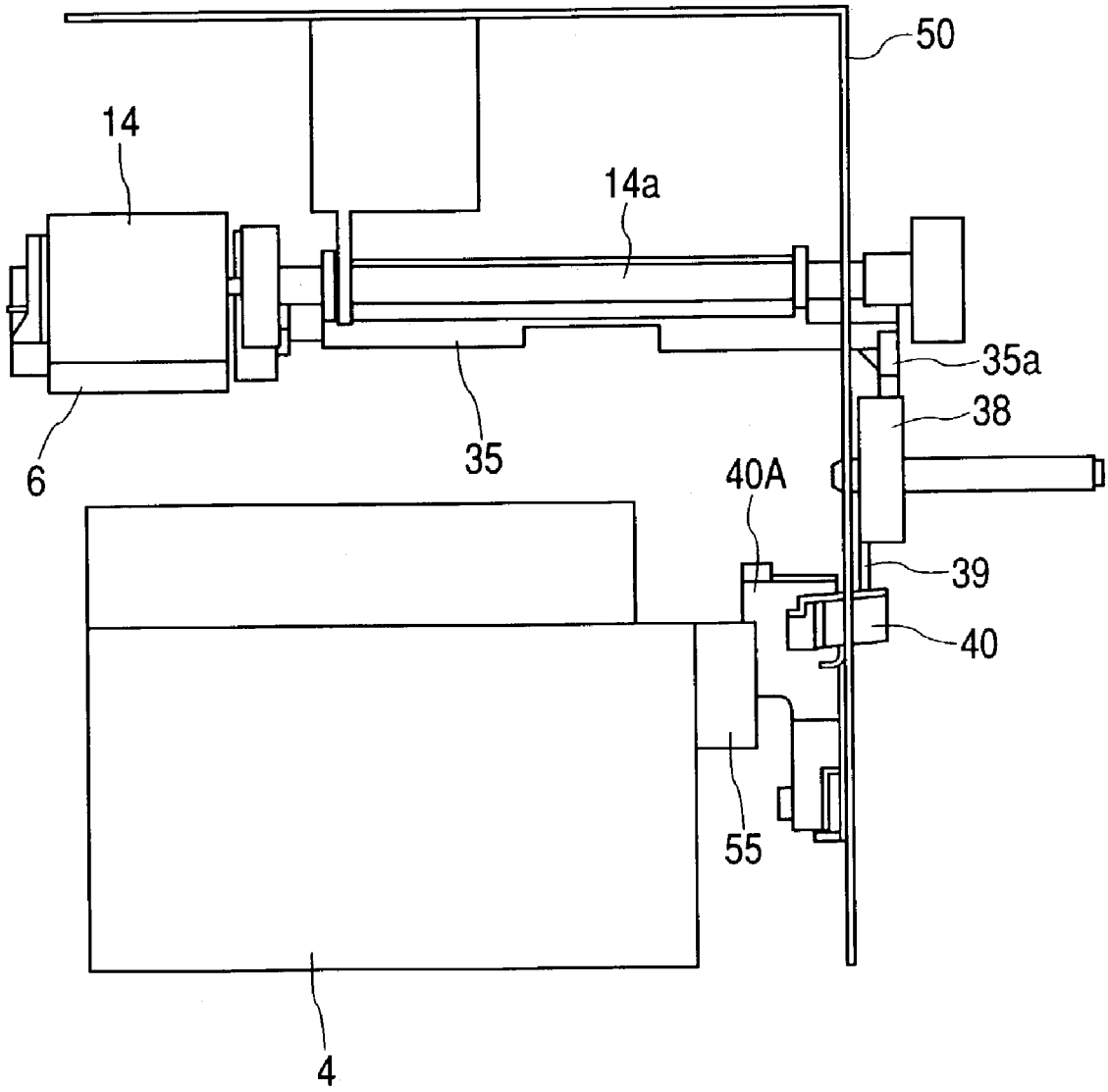
FIG. 6 is a front view showing a state of the laser beam printer in which the sheet feeding cassette has been accommodated therein.
Figure 7:
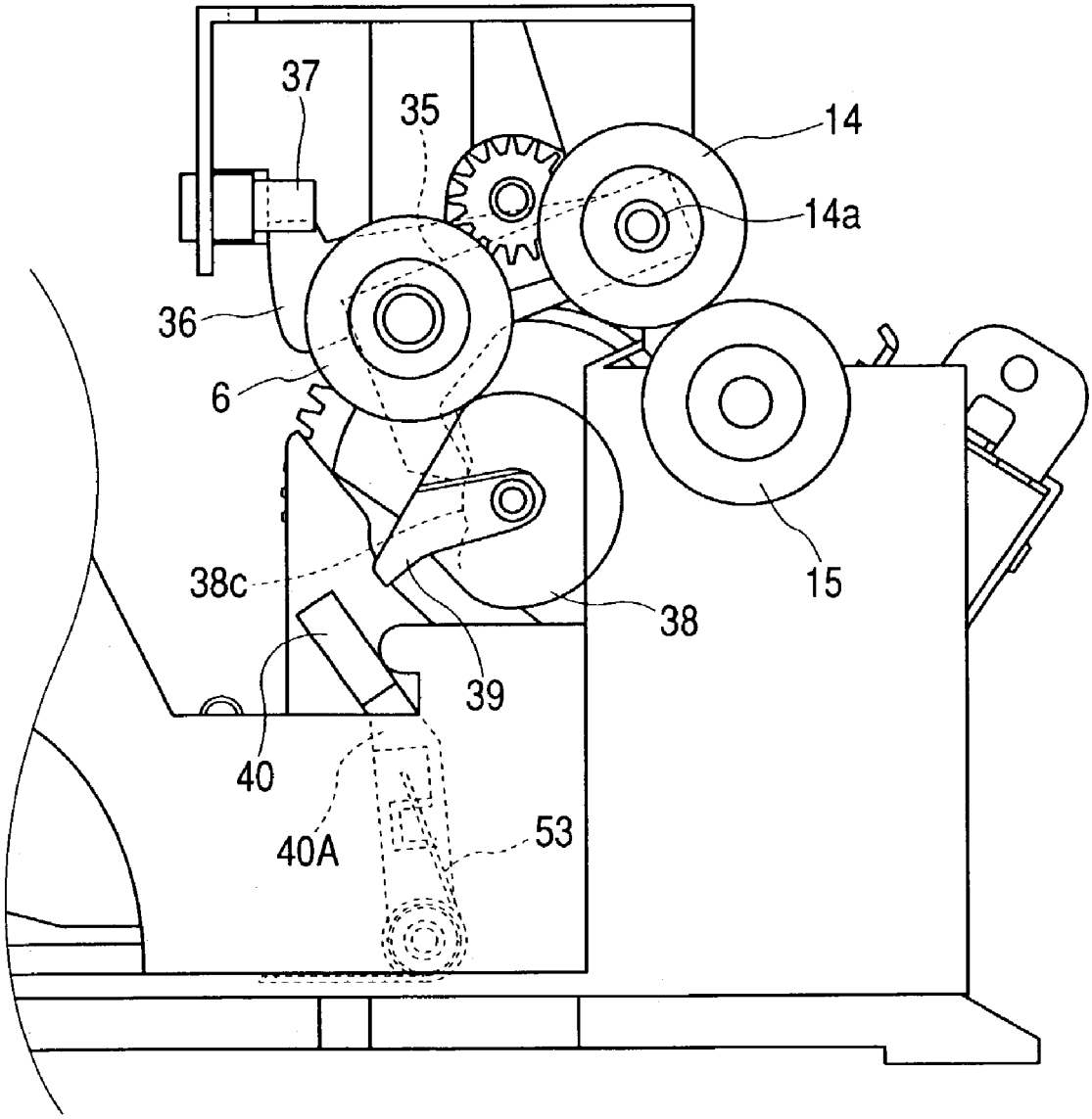
FIG. 7 is a main-portion side view showing a state of the sheet feeding device, in which the sheet feeding cassette has been accommodated in the laser beam printer.
Figure 8:
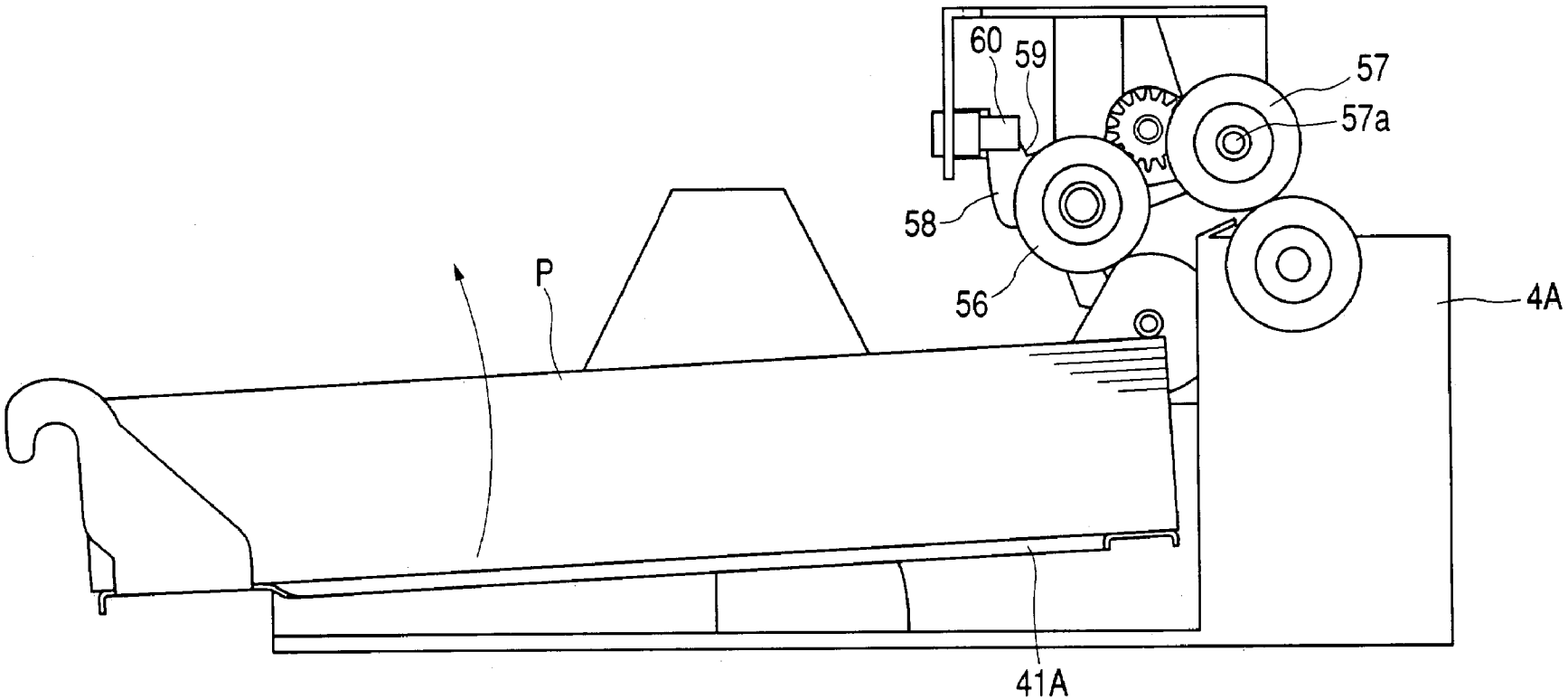
FIG. 8 is a diagram illustrating a construction of a conventional sheet feeding device.

Note that, as shown in FIGS. 5 and 6, when the sheet feeding cassette 4 is accommodated, this canceling member 40A is pressurized by a pressurizing member 55 provided on one side surface of the sheet feeding cassette 4 and rotates toward the depth side with respect to the cassette accommodating direction. And, when the canceling member 40A is pressurized by the sheet feeding cassette 4 to rotate, the lever 40 pressurizes the engagement portion 39, and the cam member 38 rotates independently clockwise as shown in FIG. 7. Further, when the cam member 38 thus rotates, the abutment portion 35*a* of the roller holder 35, which has been in contact with the circumferential surface 38*b* of the cam member 38 as shown in FIG. 3, is detached from the circumferential surface 38*b* of the cam member 38, and falls along a linear portion 38*c* of the cam member 38.

When the roller holder 35 falls described above, the pick-up roller 6 descends from the initial position, with the result that the shielding by the sensor flag 36 is canceled, bringing the position detection sensor 37 into the non-detection state.

And, when the position detection sensor 37 is thus brought into the non-detection state, the control portion 11 serving as the control means drives the motor (not shown) to raise the inner plate 41 through the push-up plate 54 serving as the lifter means. As a result, the uppermost surface of the sheets P comes into contact with the pick-up roller 6. After that, when the inner plate 41 further ascends, the pick-up roller 6 reaches the position where the position detection sensor 37 is shielded by the sensor flag 36 to bring the sensor in the detection state, whereby the inner plate 41 stops at the substantially predetermined level at which the proper sheet feeding pressure is applied to the sheets P between the pick-up roller 6 and the uppermost surface of the sheets P.

When the pick-up roller 6 thus ascends with the ascent of the inner plate 41, the abutment portion 35*a* of the roller holder 35 is detached from the linear portion 38*c* of the cam member 38. Then, when the abutment portion 35*a* is thus detached from the cam member 38, the cam member 38 is restored to the initial state as shown in FIG. 3.

In this way, due to the cam configuration as described above, the cam member 38 performs positional control so as to restore the pick-up roller 6 to the initial position. Even if the cam member 38 is not restored to the former state, when sheet feeding operation is started thereafter and the partially-toothless gear 31 rotates, the cam member 38 is thereby caused to rotate and is restored to the former state.

Further, as shown in FIG. 3, a spring 53 is mounted to the canceling member 40A, and, when the canceling member

40A is pressurized by the sheet feeding cassette 4 to rotate counterclockwise, it is urged clockwise by this spring 53. Thus, when the sheet feeding cassette 4 is drawn out to supply sheets, the lever 40 reliably returns from the position as shown in FIG. 7 to the position as shown in FIG. 3.

When the canceling member 40A thus returns, the lever 40 abuts against the engagement portion 39 of the cam member 38. However, as described above, this engagement portion 39 is mounted to the shaft 38*a* of the cam member 38 so as to be capable of rotating counterclockwise by only a predetermined angle, so that the lever 40 returns to the position where it is pressurized by the accommodated sheet feeding cassette 4 while causing the engagement portion 39 to rotate counterclockwise, that is, without being hindered in its return rotation by the engagement portion 39.

In this way, when accommodating the sheet feeding cassette 4 in the apparatus main body 1A, the raising operation of the cam member 38 is canceled by the canceling member 40A, and the pick-up roller 6 is lowered from the initial position, whereby it is possible to bring the position detection sensor 37 into the non-detection state. Thus, thereafter, if the inner plate 41 is raised to the position where the position detection sensor 37 is brought into the detection state again, it is possible to move the sheets on the inner plate 41 to the position where sheet feeding is possible with reliable and simple construction.

What is claimed is:

1. A sheet feeding device comprising:

sheet containing means detachably attached to an apparatus main body for containing sheets;

sheet pick-up means adapted to vertically move for feeding the sheet contained in said sheet containing means, a sheet support member provided in the sheet containing means and adapted to vertically move while supporting the sheets;

lifter means for raising said sheet support member so as to bring an uppermost surface of the sheets supported by said sheet support member to a predetermined height;

a cam member mounted rotatably and adapted to lower the sheet pick-up means so as to bring it into contact with the sheets when the uppermost surface of the sheets is raised to the predetermined height, and adapted to raise the sheet pick-up means to an upper initial position above the uppermost surface of the sheets on standby;

detection means for detecting a height of the uppermost surface of the sheets according to a position at which the sheet pick-up means contact with the sheets; and control means for controlling the raising operations of said lifter means on the basis of the result of the detection of the height of the uppermost surface of the sheets so as to maintain the uppermost surface of the sheets supported by the sheet support member at a predetermined height, wherein, when the sheet containing means is attached in the apparatus main body, and said cam member is pressurized and rotated by said sheet containing means, so the raising operation of said cam member is canceled by the rotation of the cam member, and the sheet pick-up means is lowered from the upper initial position so as to enable said detection means to perform detection.

2. A sheet feeding device according to claim 1, further comprising a canceling member to be pressurized and to be moved by the sheet containing means when the sheet containing means is attached to the apparatus main body, wherein when said canceling member moves by said sheet containing means, said canceling member rotates said cam member, and the retention of the sheet pick-up means at the initial position by said cam member is canceled by the detachment of the sheet pick-up means from said cam member.

3. A sheet feeding device according to claim 2, further comprising a spring for returning said canceling member to a position where said canceling member may be pressurized by the sheet containing means, when the sheet containing means is drawn from the apparatus main body.

4. A sheet feeding device according to claim 3, wherein said cam member is equipped with a pressurization portion to be pressurized by said canceling member, and wherein the pressurization portion is mounted to the cam member so as to be capable of rotating by only a predetermined angle, and the pressurization portion does not prevent said canceling member from returning to the position where it is pressurized by the sheet containing means.

5. A sheet feeding device according to claim 1, wherein said cam member is provided coaxially with a partially-toothless gear forming a one-revolution control clutch, and wherein said cam member and said partially-toothless gear are mounted so as to provide a relative rotation within a predetermined angle range.

6. A sheet feeding device according to claim 5, wherein the sheet pick-up means is transmitted a rotation and controlled in its rotation by said one-revolution control clutch, and wherein each time the cam member is rotated once by said one-revolution control clutch, the rotation of said cam member causes the sheet pick-up means to move between the initial position and a feeding position in which the sheet pick-up means abuts against the sheets.

7. A sheet feeding device comprising:

a sheet feeding cassette detachably attached to an apparatus main body;

a pick-up roller which feeds out the sheet contained said sheet feeding cassette;

a holder for supporting the pick-up roller so as to allow the pick-up roller to swing vertically;

an inner plate which is rotatably provided in the sheet feeding cassette and on which sheets are stacked;

a push-up plate provided in the apparatus main body and adapted to push up said inner plate by rotating;

a cam member having an outer circumferential portion adapted to abut against an abutment portion provided on said holder to raise the pick-up roller to a position above the sheet feeding cassette, and a linear portion adapted to lower the pick-up roller so as to bring the pick-up roller into contact with an uppermost surface of the sheets stacked on said inner plate;

a position detection sensor adapted to detect whether the position in which the pick-up roller abuts against the sheets is set at a predetermined position on the basis of whether a flag provided on said holder is detected;

control means for controlling the pushing-up operation of said push-up plate on the basis of the detection by said position detection sensor; and a lever adapted to rotate said cam member to cause the portion of said cam member against which said holder abuts to shift from the outer circumferential portion to the linear portion when the sheet feeding cassette is attached to the apparatus main body.

8. A sheet feeding device according to claim 7, further comprising separation means for separating from each other the sheets sent out from the sheet feeding cassette by the pick-up roller, wherein said separation means has a feed roller adapted to rotate in a direction in which the sheets are fed and a retard roller provided so as to be brought into pressure contact with said feed roller and adapted to rotate in a direction opposite to the direction in which the sheets are fed.

9. An image forming apparatus comprising:

image forming means for forming images on sheets;

sheet containing means detachably attached to an apparatus main body and adapted to contain sheets to be supplied to said image forming means;

sheet pick-up means adapted to vertically move for feeding the sheets contained in said sheet containing means;

a sheet support member provided in said sheet containing means and adapted to vertically move while supporting the sheets;

lifter means for raising said sheet support member so as to bring an uppermost surface of the sheets supported by said sheet support member to a predetermined height;

a cam member mounted rotatably and adapted to lower said sheet pick-up means so as to bring it into contact with the sheets when the uppermost surface of the sheets is raised to the predetermined height, and adapted to raise said sheet pick-up means to an upper initial position above the uppermost surface of the sheets on standby;

detection means for detecting the height of the uppermost surface of the sheets according to the position in which said sheet pick-up means contact with the sheets; and control means adapted to control the raising operations of said lifter means on the basis of the result of detection of the height of the uppermost surface of the sheets so as to maintain the uppermost surface of the sheets supported by said sheet support member at a predetermined height, wherein, when said sheet containing means is attached in said apparatus main body, and said cam member is pressurized and rotated by said sheet containing means, so the raising operation of said cam member is canceled by the rotation of the cam member, and said sheet pick-up means is lowered from the upper initial position so as to enable said detection means to perform detection.

10. A sheet feeding device according to claim 9, further comprising a canceling member to be pressurized and to be moved by the sheet containing means when the sheet containing means is attached to the apparatus main body, wherein when said canceling member moves by said sheet containing means, said canceling member rotates said cam member, and the retention of the sheet pick-up means at the initial position by said cam member is canceled by the detachment of the sheet pick-up means from said cam member.

11. A sheet feeding device according to claim 10, further comprising a spring for returning said canceling member to a position where said canceling member is possible pressurized by the sheet containing means when the sheet containing means is drawn from the apparatus main body.

12. A sheet feeding device according to claim 11, wherein said cam member is equipped with a pressurization portion to be pressurized by said canceling member, and wherein the pressurization portion is mounted to the cam member so as to be capable of rotating by only a predetermined angle, and the pressurization portion does not prevent said canceling member from returning to the position where it is pressurized by the sheet containing means.

13. A sheet feeding device according to claim 9, wherein said cam member is provided coaxially with a partially-toothless gear forming a one-revolution control clutch, and wherein said cam member and said partially-toothless gear are mounted so as to provide a relative rotation within a predetermined angle range.

14. A sheet feeding device according to claim 13, wherein the sheet pick-up means is transmitted a rotation and controlled in its rotation by said one-revolution control clutch, and wherein each time the cam member is one rotated by said one-revolution control clutch, the rotation of said cam member causes the sheet pick-up means to move between the initial position and a feeding position in which the sheet pick-up means abuts against the sheets.

15. An image forming apparatus comprises:

a sheet feeding cassette detachably attached to an apparatus main body;

a pick-up roller which feeds out the sheet contained said sheet feeding cassette to an image forming portion;

a holder supporting the pick-up roller so as to allow the pick-up roller to swing vertically;

an inner plate which is rotatably provided in the sheet feeding cassette and on which sheets are stacked;

a push-up plate provided in the apparatus main body and adapted to push up said inner plate by rotating;

a cam member having an outer circumferential portion adapted to abut against an abutment portion provided on said holder to raise the pick-up roller to a position above the sheet feeding cassette, and a linear portion adapted to lower the pick-up roller so as to bring the pick-up roller into contact with an uppermost surface of the sheets stacked on said inner plate;

a position detection sensor adapted to detect whether the position in which the pick-up roller abuts against the sheets is set at a predetermined position on the basis of whether a flag provided on said holder is detected;

control means for controlling the pushing-up operation of said push-up plate on the basis of the detection by said position detection sensor; and a lever adapted to rotate said cam member to cause the portion of said cam member against which said holder abuts to shift from the outer circumferential portion to the linear portion when the sheet feeding cassette is attached to the apparatus main body.

* * * * *

UNITED STATES PATENT AND TRADEMARK OFFICE

CERTIFICATE OF CORRECTION

PATENT NO. : 6,994,341 B2
APPLICATION NO. : 10/606312
DATED : February 7, 2006
INVENTOR(S) : Daisuke Aoki et al.

It is certified that error appears in the above-identified patent and that said Letters Patent is hereby corrected as shown below:

COLUMN 4:
Line 12, "rotate." should read --rotates.--.

COLUMN 5:
Line 39, "falls to moved" should read --descends--.

COLUMN 7:
Line 49, "contact" should read --contacts--.

COLUMN 8:
Line 37, "contained" should read --contained on--.

COLUMN 10:
Line 28, "contained" should read --contained on--.

Signed and Sealed this

Fifteenth Day of August, 2006

JON W. DUDAS
*Director of the United States Patent and Trademark Office*